US005606879A

United States Patent [19]

Froelicher et al.

[11] Patent Number: 5,606,879

[45] Date of Patent: Mar. 4, 1997

[54] AUTOMATIC WASHING MACHINE SUSPENSION SYSTEM

[75] Inventors: Stephen B. Froelicher, Louisville; Frank H. Richterkessing, Jr., Mt. Washington, both of Ky.

[73] Assignee: General Electric Company, Louisville, Ky.

[21] Appl. No.: 450,487

[22] Filed: May 26, 1995

[51] Int. Cl.[6] ..... D06F 37/24

[52] U.S. Cl. ..... 68/23.3; 188/129; 188/381

[58] Field of Search ..... 68/23.1, 23.3; 248/638; 188/129, 381

[56] References Cited

U.S. PATENT DOCUMENTS

| | | | |
|---|---|---|---|
| 2,912,206 | 11/1959 | Dillenburger | 188/88 |
| 3,306,082 | 2/1967 | Hasegawa et al. . | |
| 3,321,940 | 5/1967 | Brucken | 68/23.3 |
| 5,080,204 | 1/1992 | Bauer et al. | 188/129 |
| 5,174,551 | 12/1992 | Mintgen | 267/120 |

FOREIGN PATENT DOCUMENTS

| | | |
|---|---|---|
| 0256390 | 2/1988 | European Pat. Off. . |
| 5154283 | 6/1993 | Japan . |

*Primary Examiner*—Philip R. Coe
*Attorney, Agent, or Firm*—H. Neil Houser

[57] ABSTRACT

An automatic washing machine suspension system includes a plurality of suspension units. Each unit includes a rod suspended from a stationary support ring. A hollow cylinder, with a cylindrical side wall and a transverse base, is connected to the moving system and is mounted around the distal end of the rod. A piston mounted on the rod within the cylinder side wall includes a circumferentially continuous skirt extending axially of the side wall. A retainer spring mounted on the rod within the skirt includes a series cantilever beam fingers biasing the piston skirt into engagement with the cylinder side wall. A washer is mounted on the rod within the fingers. A coil spring is mounted around the rod and extends between the base of the cylinder and the piston.

19 Claims, 2 Drawing Sheets

Fig. 4
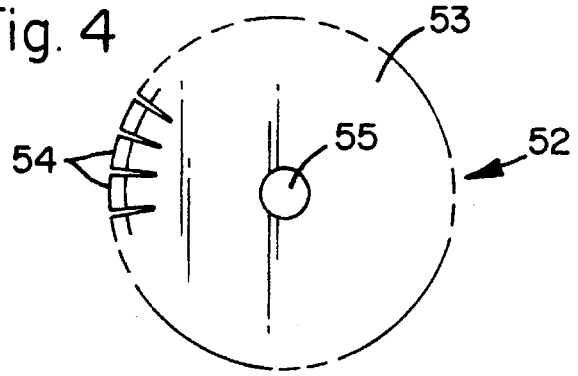
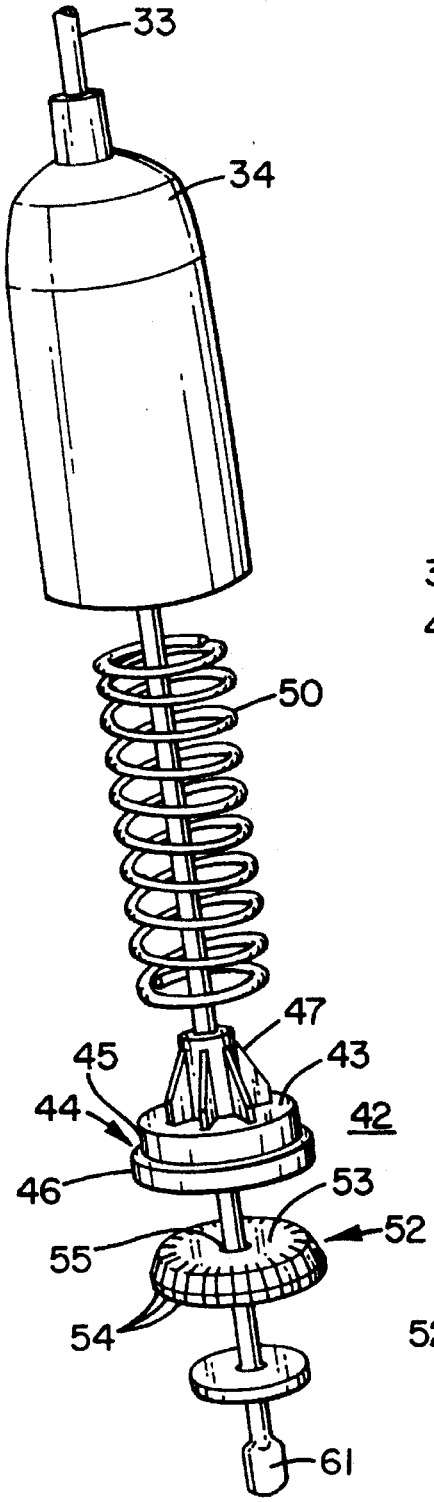
Fig. 2
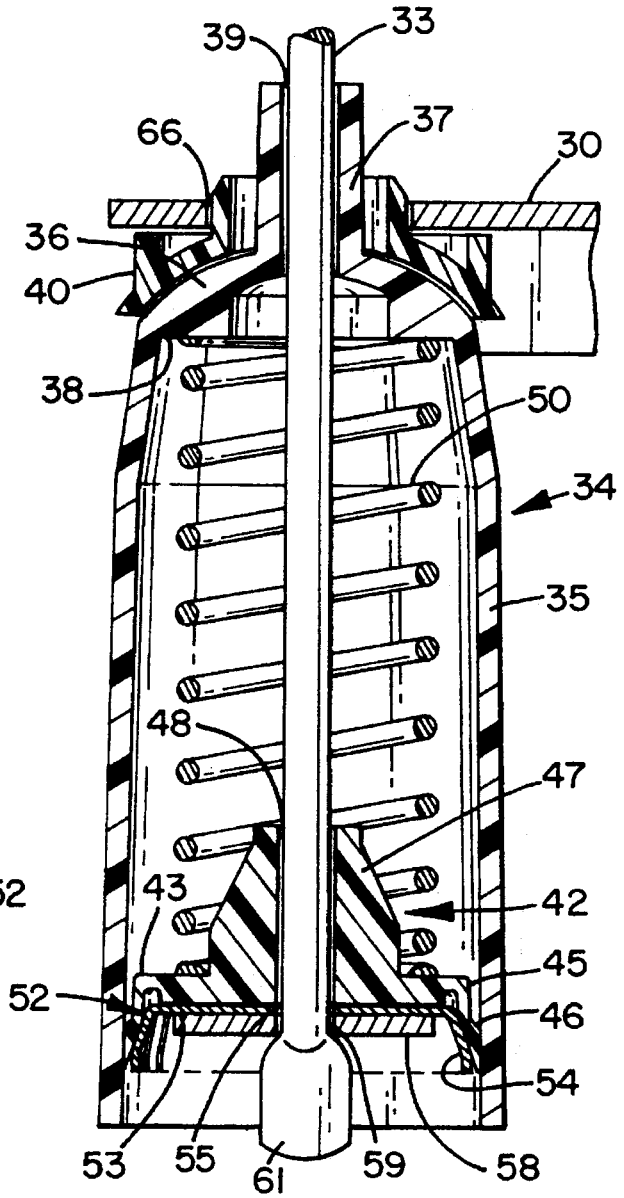
Fig. 3

AUTOMATIC WASHING MACHINE SUSPENSION SYSTEM

BACKGROUND 0F THE INVENTION

The present invention relates to automatic fabric washing machines and, more particularly to an improved system for damping the movement of the moving system of the machine. Modern clothes or fabric washing machines have a moving system, normally including a tub to hold water and a basket within the tub to hold the fabrics to be washed, along with the drive motor and a transmission. The moving system is supported from a stationary support structure, normally the housing of the machine. The moving system needs to have some degree of movement relative to the support structure to permit the system to respond to forces generated during the agitation and spin operations of the machine. At the same time it is necessary to damp the motion, particularly during spin to prevent excess travel of the moving system. Numerous different systems have been used to damp this motion, including a number of systems incorporating rod and piston arrangements. It is very desirable that the force between the piston and its surrounding cylinder wall remain generally constant through the life of the machine so that the damping system will continue to perform properly as the machine ages. At the same time it is necessary that the damping system be easily constructed and be made of relatively inexpensive components.

An object of this invention is to provide an automatic fabric washing machine including an improved system for damping movement of the moving system relative to the stationary structure.

Another object is to provide such an improved system in which the suspension units maintain their damping action as the machine ages.

Yet another object is to provide such an improved system incorporating cylinder and piston units incorporating improved means for prevent the piston from taking a compression set relative to the side wall of the cylinder.

SUMMARY OF THE INVENTION

In accordance with one embodiment of the present invention an automatic fabric washing machine has a moving system and a stationary support structure. A plurality of suspension units or assemblies connect the moving system to the support structure for dampened movement therebetween. Each suspension unit includes a hollow cylinder engaging the support structure. The cylinder includes an elongated, generally circular side wall with a transverse base at one end thereof. An elongated rod includes one end received through the base of the cylinder and its other end mounted on the support structure. A piston is mounted on the rod within the cylinder and includes a circumferential skirt extending axially of the cylinder side wall. A retainer spring is mounted on the rod within the piston skirt and includes a skirt with a series of cantilever beam fingers closely spaced apart around the inside of the piston skirt and biasing the piston skirt into engagement with the cylinder side wall. A washer is mounted on the rod within the retainer spring skirt and in engagement with the retainer spring.

BRIEF DESCRIPTION OF THE DRAWINGS

FIG. 2 is a perspective view of the lower portion of one suspension unit incorporated in the machine of FIG. 1.

FIG. 3 is a cross-section view of the lower portion of the suspension unit of FIG. 2.

FIG. 4 is a fragmentary plan view of the retainer spring incorporated in the suspension unit of FIG. 2.

DETAILED DESCRIPTION OF PREFERRED EMBODIMENT

Figure 1:
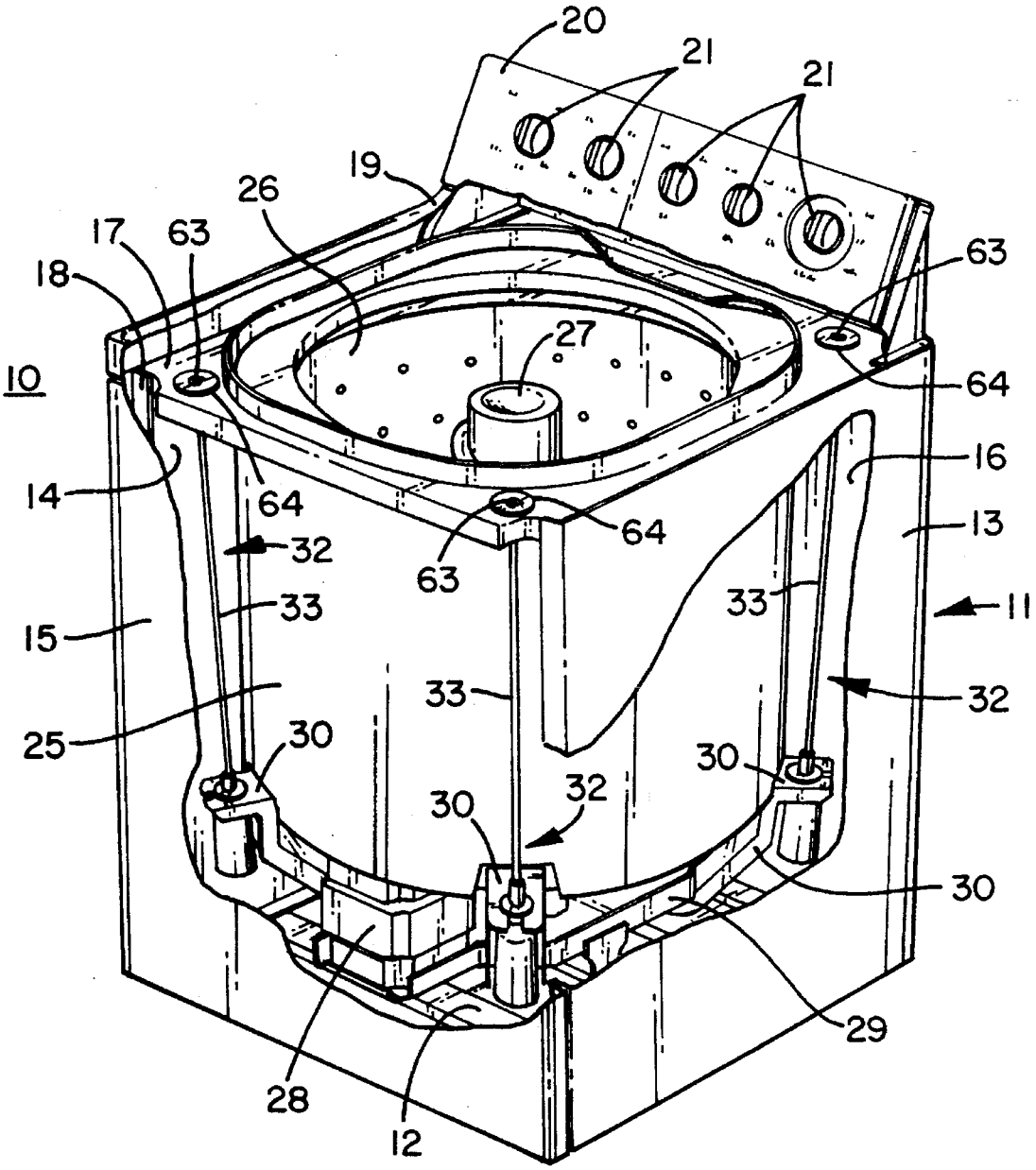
FIG. 1 is a somewhat simplified perspective view of an automatic clothes washing machine incorporating one embodiment of the present invention, the view being partly broken away for purposes of illustration.

FIG. 1 illustrates an automatic clothes or fabric washing machine 10 of the vertical agitator type. The machine 10 includes a cabinet or housing 11 with a base 12 and lateral walls joined to the base and extending upward around the periphery of the base 12. In the illustrative machine the base 12 is rectangular and the lateral walls include spaced apart side walls 13,14 joined by front wall 15 and rear wall 16. The top edges of the walls 13–16 are connected to a support ring or collar 17, which is supported above the base 12 by four corner posts, one of which is shown at 18. A top wall 19 is mounted over the ring 17 and walls 13–16 and includes a central opening and lid, not shown, which provide the user with access to the inside of the machine. A backsplash 20 is mounted on the rear portion of the top wall 19 and encloses various controls 21 which the user adjusts to control operation of the machine.

The cabinet thus far described forms a support structure which encloses and supports the various operating components of the machine and which constitute what is normally called the moving system. The moving or operating system includes an imperforate tub 25 to hold water for washing and rinsing clothes and other fabrics. A perforate basket 26 is mounted in the tub and holds the items to be washed. A vertical axis agitator 27 extends upward within the basket 26 and is oscillated to effect washing and rinsing of the fabrics. The agitator is oscillated and the basket is rotated at high speed by a motor 28 and transmission, not shown, as is well known in the art. The various components of the moving system are mounted on a platform 29. An integral foot 30 is provided at each corner of the platform 29. The details of construction and connection of the various operational components is not part of the present invention and a detailed showing of them has been omitted for the sake of simplicity.

The operating or moving system is mounted to the stationary support structure by a suspension system which includes a suspension unit or assembly 32 at each corner of the machine. The units 32 connect the platform 30 to the support ring or collar. The units 32 reduce the transmission of forces to the outer cabinet and snub or damp the high amplitude movement of the moving system as the basket 26 accelerates through its critical speed.

Referring now to FIGS. 1–3, the suspension units conveniently are identical in construction and only one unit will be described. The unit or assembly 32 includes an elongated metal rod 33. A hollow, cup like cylinder 34 is provided at the lower portion of the rod 33. The cylinder 34 includes an elongated,circular cross section side wall 35 extending axially of the rod 33. A transverse top wall or base 36 extends across and substantially closes the top of the cylinder 34. The top wall includes an outwardly projecting neck portion 37 and an inner, flat bearing surface 38. The top wall 36 includes an axial opening 39 through which the lower portion of the rod extends. A wear member 40 is positioned around the outside of top wall 36 and neck 37.

A piston 42 is mounted on the rod within the side wall 35 of the cylinder 34. The piston includes a generally circular transverse top wall or base 43 with a generally cylindrical skirt 44 projecting downward from the outer circumference of the base 43. The skirt 44 includes an axially upper and radially inward section 45 and an axially lower and radially outer section 46. The outside of the skirt 44 engages the inside of the cylinder side wall 35. The piston base 43 includes an upwardly projecting hub 47. An axial opening 48 is formed through the base 43 and hub 47 through which the lower portion of rod 33 extends. A damping member in the form of a coil spring 50 is mounted around the lower portion of the rod 33 with its upper end engaging the bearing surface 38 on the inside of the cylinder top wall 36 and its lower end engaging the upper surface of piston base 43.

A retainer spring 52 is mounted on the lower portion of the rod 33 within the piston skirt 44. The retainer spring 52 includes a generally circular top wall or base 53 projecting transverse to the rod 33. A series of closely spaced apart fingers 54 project outwardly and downwardly around the circumference of the wall 53. The fingers are in the form of cantilever beams and the distal ends of the fingers engage the inside of piston skirt 44. The lower portion of rod 33 passes through an opening 55 in the center of spring base 53.

A circular washer 58 is positioned below the retainer spring top wall 53 and includes a central opening 59 through which the lower portion of rod 33 extends. The lower end 61 of rod 33 is expanded or coined to have a dimension larger than the openings 39, 48, 55 and 59, which prevents the cylinder 34, piston 42, retainer spring 52, and washer 58 from passing over the lower end of rod 33.

The suspension unit or assembly 32 is connected to the support ring 17 and to the platform 29. More particularly the upper end of the rod 33 passes through an opening, not shown, at one corner of the ring 17 and the rod is provided with an enlarged head or cap 63 which prevents the rod from falling through the ring 17. If desired the ring 17 can be formed with recesses 64 that surround the openings in the ring and receive the caps 63. The lower portion of the assembly 32 is positioned below the corresponding foot 30 and the wear member 40 is positioned in an opening 66 in the foot 30. If desired, the suspension units or assemblies could be reversed or turned upside down with respect to the machine.

The coil spring 50 holds the cylinder 34 and wear member 40 against the bottom of foot 30 and the washer 58 against the coined end 61 of rod 33. The parts are sized so that, when the machine is empty, coil spring 50 is under a relatively light compression force. When the machine is loaded the weight of the fabrics and water in the basket 26 and tub 25 lower the moving system, substantially increasing the compression force on spring 50. During operation the moving system tends to move relative to the support structure. This causes the feet 30 to move vertically and transversely relative to the support ring 17. The coil springs 50 hold the cylinders 34 against the feet 30 while the pistons move within the cylinders to damp the movement of the moving system. The damping effect of each assembly 32 results from the friction of the sliding engagement of the piston skirt 44 against the inside surfaces of the cylinder side wall 35 and from the passage of air through the openings 39, 48, 55 and 59 around the rod 33.

It is important that the damping effect remain substantially consistent during the life of the washing machine. However, over time the piston skirt 44 can creep under pressure and assume a compression set such that the friction force between the skirt and the inside of cylinder side wall 35 will decrease enough to adversely effect the operation of the machine. The retainer spring fingers exert an uniformly distributed outward directed force on the inside of the piston skirt 44. This sufficiently limits, and preferably prevents, the compression set of the skirt 44.

In the exemplification embodiment, the rod 33, coil spring 50 and washer 58 are formed of steel; the cylinder 34 is formed of high density polyethelene; the piston is formed of a suitable thermoplastic elastomer, such as DuPont Hytrel 7246 for example; the wear member is formed of 30% glass nylon 6/6; and the retainer spring is formed of 260A151 brass (commonly referred to as cartridge brass). It will be understood that various components can be formed of other suitable materials. For example the retainer spring 52 can be formed from phorphorus bronze.

The retainer spring conducts heat from the piston and the washer 58 enhances the transfer of heat from the retainer spring to the rod 33. In the exemplification embodiment, it presently is preferred that the retainer spring have a thermal conductivity between about 25 and about 125 BTUs per (hour $Ft^{2\circ}$ F.).

While a specific embodiment of the invention has been illustrated and described herein, it is realized that modifications and changes will occur to those skilled in the art to which the invention pertains. It is therefore to be understood that the appended claims are intended to cover all such modifications and changes as fall within the true spirit and scope of the invention.

What is claimed is:

1. An automatic fabric washing machine comprising a moving system, a stationary support structure and a plurality of suspension units connecting said moving system to said support structure for dampened movement therebetween, each of said suspension units comprising:

a hollow cylinder engaging one of said moving system and said support structure, said cylinder comprising an elongated generally circular side wall with a transverse base adjacent one end thereof;

an elongated rod with spaced apart ends, one of said rod ends received in said cylinder through said base and the other of said rod ends engaging the other of said moving system and said support structure;

a piston mounted on said rod adjacent said one end and comprising a circumferentially continuous skirt extending generally axially of said cylinder side wall;

a retainer spring mounted on said rod within said piston skirt, said spring comprising a skirt comprising a series of cantilever beam fingers closely spaced apart around the inside of said piston skirt and biasing said piston skirt into engagement with said cylinder side wall; and a washer mounted on said rod within said retainer spring skirt and engaging said retainer spring so that said retainer spring transfers heat from said piston to said washer.

2. An automatic washing machine as set forth in claim 1, wherein:

said retainer springs have a thermal conductivity between about 25 and about 125 BTUs per hour.

3. An automatic washing machine as set forth in claim 1, wherein:

each piston includes a base extending transversely inwardly of its skirt; and each retainer spring includes a base extending transversely inward of its skirt;

each retainer spring base being juxtaposed between the base of the corresponding piston and the corresponding washer.

4. An automatic washing machine as set forth in claim 1, wherein: said cylinder and piston are formed of suitable plastic materials and said retainer spring is formed of a suitable metal.

5. An automatic washing machine as set forth in claim 4, wherein: said cylinders are formed of a high density polyethelene.

6. An automatic washing machine as set forth in claim 4, wherein: said pistons are formed of a thermoplastic elastomer.

7. An automatic washing machine as set forth in claim 4, wherein said retainer spring is formed from a metal selected from brass and bronze.

8. An automatic washing machine as set forth in claim 1, wherein:

each of said pistons includes a base extending transversely inward of its skirt; and each of said suspension units includes a coil spring mounted about the one end of said corresponding rod and engaging the transverse bases of the corresponding cylinder and piston.

9. A piston assembly for a suspension unit of a suspension system for a washing machine having a moving system and a stationary support structure, the suspension system including a plurality of suspension units connecting the moving system to the support structure for dampened movement therebetween, each of the suspension units including a hollow cylinder engaging one of the moving system and the support structure, the cylinder having an elongated generally circular side wall with a transverse base adjacent one end thereof, each of the suspension units further including an elongated rod with spaced apart ends, one of the rod ends received in the cylinder through the base and the other of the rod ends engaging the other of the moving system and the support structure, said piston assembly comprising:

a piston configured to be mounted on the rod adjacent the one end and comprising a circumferentially continuous skirt extending generally axially of the cylinder side wall;

a retainer spring configured to be mounted on the rod within said piston skirt, said spring comprising a skirt comprising a series of cantilever beam fingers closely spaced apart and configured to bias said piston skirt into engagement with the cylinder side wall; and a heat transfer member configured to be mounted on the rod and within said retainer spring skirt, said heat transfer member configured to engage said retainer spring.

10. A piston assembly in accordance with claim 9 wherein said retainer spring is formed from a metal selected from brass and bronze.

11. A piston assembly in accordance with claim 9 wherein said continuous piston skirt comprising an axially upper and radially inward section and an axially lower and radially outer section.

12. A piston assembly in accordance with claim 9 wherein said heat transfer member is a washer.

13. A piston assembly in accordance with claim 9 wherein said retainer spring has a thermal conductivity between about 25 and about 125 BTUs per hour.

14. A piston assembly in accordance with claim 9 wherein said piston further comprises a base extending transversely of said continuous skirt.

15. A piston assembly in accordance with claim 9 wherein said piston is a plastic material.

16. A piston assembly in accordance with claim 15 wherein said plastic material is a thermoplastic material.

17. A piston assembly in accordance with claim 16 wherein said retainer spring has a thermal conductivity between about 25 and about 125 BTUs per hour.

18. A piston assembly in accordance with claim 9 wherein the cylinder is formed of a high density polyethelene and said piston is formed of a thermoplastic elastomer.

19. A piston assembly in accordance with claim 18 wherein said retainer spring is formed from a metal selected from brass and bronze.

* * * * *